US007743533B2

(12) United States Patent
Stark

(10) Patent No.: US 7,743,533 B2
(45) Date of Patent: Jun. 29, 2010

(54) GARDEN SHOE HAVING BREATHING TUBES

(75) Inventor: Russell J. Stark, Lake Oswego, OR (US)

(73) Assignee: Lawngrips, LLC, Lake Oswego, OR (US)

( * ) Notice: Subject to any disclaimer, the term of this patent is extended or adjusted under 35 U.S.C. 154(b) by 563 days.

(21) Appl. No.: 11/729,054

(22) Filed: Mar. 27, 2007

(65) Prior Publication Data

US 2008/0235994 A1 Oct. 2, 2008

(51) Int. Cl.
*A43B 3/00* (2006.01)
*A43B 7/06* (2006.01)

(52) U.S. Cl. ..... 36/113; 36/3 A

(58) Field of Classification Search ..... 36/50.1, 36/51–53, 114, 89–92, 170, 45, 3 A, 3 R, 36/3 B, 113
See application file for complete search history.

(56) References Cited

U.S. PATENT DOCUMENTS 102,314 A * 4/1870 Perkins ..... 36/3 A
825,851 A * 7/1906 MacKaskie ..... 36/3 R
2,190,802 A * 2/1940 Powell ..... 36/3 A
2,565,028 A * 8/1951 Keithley, Jr. ..... 36/3 A
2,591,454 A * 4/1952 Manning ..... 36/3 A
2,703,937 A * 3/1955 McGinn ..... 36/3 R
2,716,293 A * 8/1955 Rath ..... 36/3 A
3,044,188 A * 7/1962 Evangelista ..... 36/3 R

* cited by examiner

*Primary Examiner*—Jila M Mohandesi
(74) *Attorney, Agent, or Firm*—Chernoff, Vilhauer, McClung & Stenzel, LLP

(57) ABSTRACT

A waterproof garden shoe has a plurality of passageways located in the shoe upper. One or more tubes located on the upper are in fluid communication with these passageways. The tubes have an opening which allows ambient air to enter the tubes and pass into the shoes through the passageways to cool the user's feet. The openings in each tube are located below the passageways that communicate with that tube to prevent water entering the tube from entering the shoe through the passageway.

6 Claims, 1 Drawing Sheet

GARDEN SHOE HAVING BREATHING TUBES

BACKGROUND OF THE INVENTION

Shoes specifically designed for working in the garden need to be waterproof. This often is accomplished by molding them as an integral unit from rubber or a soft plastic material which is impervious to water. However, shoes of this type do not breathe like leather or fabric shoes do so the user's feet get hot when the shoes are worn in warm weather. As a result, it has become common to provide ventilation openings in the shoes to allow ambient air to enter them and cool the wearer's feet. While placing ventilation openings in garden shoes prevents the wearer's feet from becoming too warm, it also essentially prevents the shoes from being waterproof regardless of the material they are made from. While many attempts have been made to prevent water from entering ventilation openings in shoes, they have been unsuccessful in doing so.

BRIEF SUMMARY OF THE INVENTION

The subject invention overcomes the shortcoming of the prior art ventilated garden shoes by providing tubes which are attached to the shoes' upper and communicate with the inside of the shoes through passageways located in the uppers. Each tube has an opening that is located lower on the shoe than any of the passageways connected to that tube.

The foregoing and other objectives, features, and advantages of the invention will be more readily understood upon consideration of the following detailed description of the invention, taken in conjunction with the accompanying drawings.

DETAILED DESCRIPTION OF PREFERRED EMBODIMENT

Figure 1:
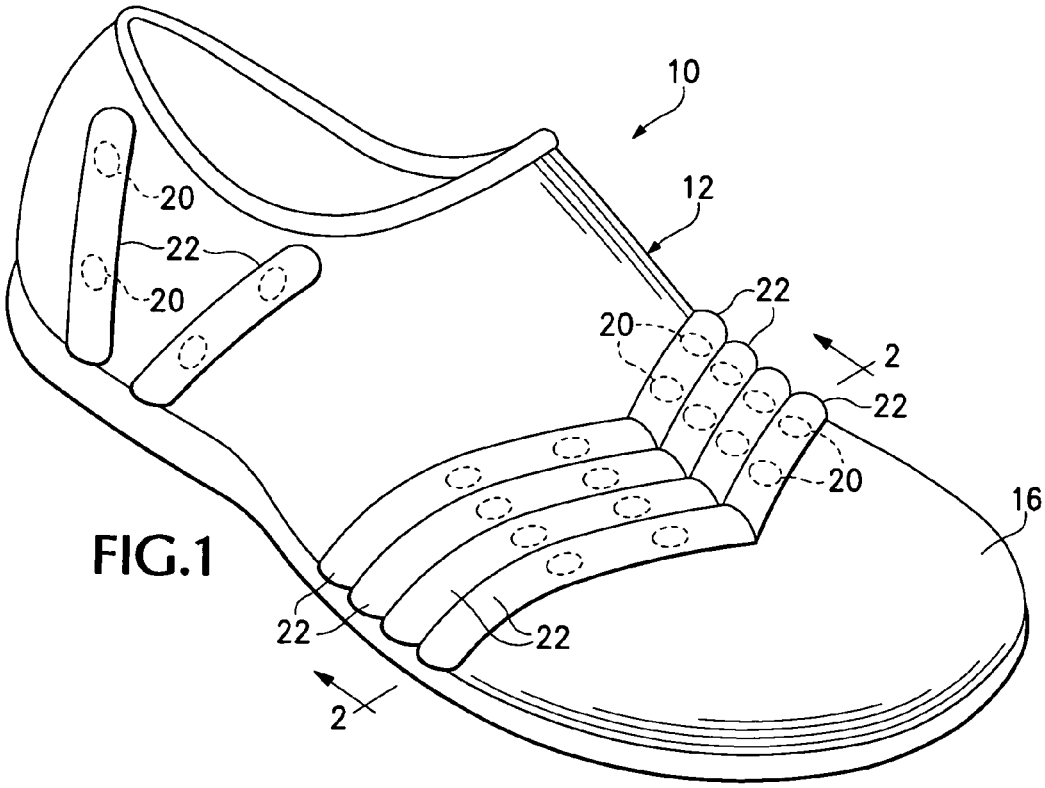
FIG. 1 is a perspective view showing a garden shoe embodying the subject invention.

Referring now to FIG. 1 of the drawings, a garden shoe 10 has an upper 12 with an inner surface 14 and an outer surface 16, and a sole 18. Preferably the upper and sole are made from a rubber or plastic material that makes them impervious to water. The upper and sole can be molded as an integral unit or it can be separate elements which are joined together by conventional means.

Located in the upper 12 are a series of passageways 20 which extend between the inner and outer surfaces 14, 16. The passageways can be located almost anywhere on the upper and are shown in the drawings as being located near the toe portion of the shoe or near the heel end of the shoe. The passageways preferably are arranged in linear rows and are symmetrical on each side of the shoe. If the shoe is molded, the passageways can be molded as an integral part of the upper.

Located on the upper 12 are a plurality of hollow tubes 22. Each tube 22 is connected to at least one passageway 20 and preferably is connected to all of the passageways in a row. If the shoe is molded the tubes preferably are formed as part of the molding process. However, they can be attached later by thermal welding or by an adhesive. In any event the tubes 22 also preferably are made from a water impervious material, and typically are made from the same material as the upper.

Figure 3:
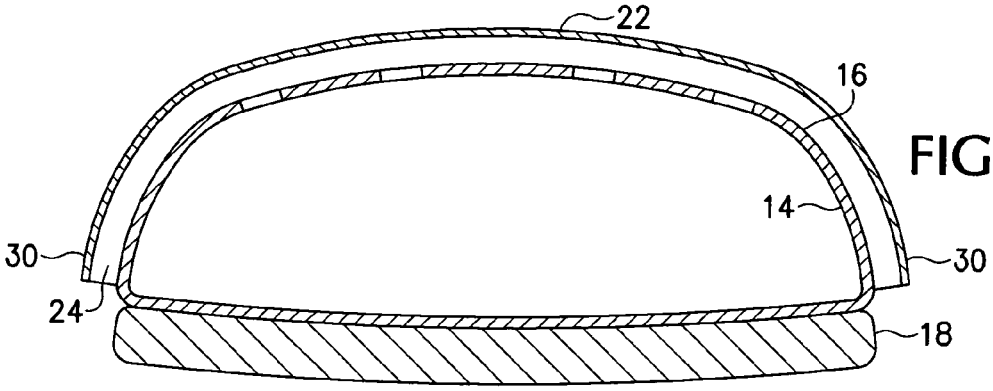
FIG. 3 is a cross-sectional view similar to FIG. 2, showing another embodiment.
Figure 2:
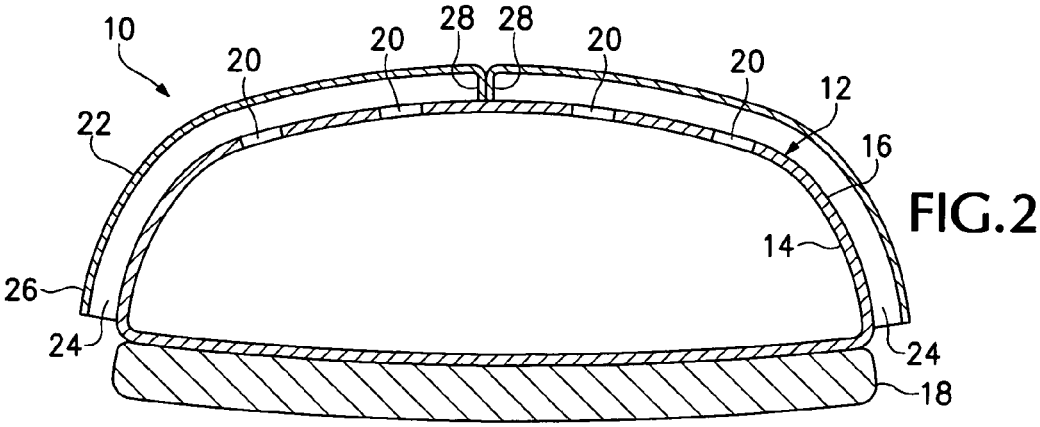
FIG. 2 is a cross-sectional view taken on line 2-2 of FIG. 1.

In addition to opening into the passageways 20, the tubes have exterior openings 24 at one or both of their ends. The openings 24 in any tube are located below all of the passageways that tube is connected to. In the embodiment illustrated the openings 24 in all of the tubes are located around where the upper 16 and sole 18 connect. While this is the preferred location of the openings 24, they can be higher on the shoe if desired. The tubes can either be connected to passageways 20 on only one side of the shoe, FIG. 2, or on passageways on both sides of the shoe, FIG. 3. In the former situation the tubes have an opening at one end 26 only and the other end 28 is sealed. In the latter situation both ends 30 are open.

Having the openings 24 in every tube located below the passageway that tube is connected to ensures that no water can enter the tube and flow up to the passageway and enter the shoe. However, ambient air can flow up the tubes into the shoes through the passageways and cool the user's feet.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. A breathable garden shoe comprising:

(a) an upper having an outer surface and inner surface;

(b) a sole connected to said upper;

(c) said upper defining a plurality of passageways, which extend between said inner and outer surfaces;

(d) at least one tube located on said outer surface, said tube having opposed ends and being in fluid communication with at least one of said passageways; and (e) said tube having openings at both of said opposed ends, said opening being located on the exterior of said shoe, said openings being below the passageways the tube communicates with.

2. The shoe of claim 1 wherein the openings in said tube are proximate where said sole is connected to said upper.

3. The shoe of claim 1 wherein said tube is integrally molded as part of said upper.

4. The shoe of claim 1 wherein said tube is attached to said outer surface.

5. The shoe of claim 1 wherein said upper and said tube are water impervious.

6. The shoe of claim 1 wherein said upper has opposing sides and each said tube is in communication with passageways on both sides of said upper.

* * * * *